US008267511B2

(12) United States Patent
Takahashi et al.

(10) Patent No.: US 8,267,511 B2
(45) Date of Patent: Sep. 18, 2012

(54) IMAGE FORMING APPARATUS

(75) Inventors: Wataru Takahashi, Miyagi (JP); Takashi Miyagi, Miyagi (JP); Naoki Okazaki, Miyagi (JP); Yoshinari Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 396 days.

(21) Appl. No.: 12/635,939

(22) Filed: Dec. 11, 2009

(65) Prior Publication Data

US 2010/0149242 A1 Jun. 17, 2010

(30) Foreign Application Priority Data

Dec. 12, 2008 (JP) ..... 2008-317618

(51) Int. Cl.
*B41J 2/01* (2006.01)

(52) U.S. Cl. ..... 347/104; 347/14; 347/19

(58) Field of Classification Search ..... 347/9–19, 347/104

See application file for complete search history.

(56) References Cited

U.S. PATENT DOCUMENTS

| | | | | |
|---|---|---|---|---|
| 5,096,044 | A * | 3/1992 | Biebel | 198/502.4 |
| 6,155,669 | A * | 12/2000 | Donahue et al. | 347/42 |
| 2006/0132572 | A1 * | 6/2006 | Mochizuki et al. | 347/104 |

FOREIGN PATENT DOCUMENTS

| | | |
|---|---|---|
| JP | 2005-7899 | 1/2005 |
| JP | 2005-225207 | 8/2005 |
| JP | 2006-159556 | 6/2006 |

OTHER PUBLICATIONS

U.S. Appl. No. 12/574,966, filed Oct. 7, 2009.

* cited by examiner

*Primary Examiner* — Manish S Shah
(74) *Attorney, Agent, or Firm* — Cooper & Dunham LLP

(57) ABSTRACT

An image forming apparatus includes an ink discharge unit including nozzles to discharge ink and to form an image on a recording medium; a conveyer belt to convey the recording medium so that the recording medium passes through an area facing the ink discharge unit, the conveyor belt including blank discharge holes to let the ink for a blank discharge through; a control unit to control an ink discharge operation of the ink discharge unit; a blank discharge receiver to receive the ink for the blank discharge, provided at a position facing the ink discharge unit across the conveyor belt; and a belt position detection unit to detect a position in a direction perpendicular to a belt moving direction of the conveyor belt, wherein the control unit controls the blank discharge operation of the ink discharge unit based on a detection result detected by the belt position detection unit.

7 Claims, 11 Drawing Sheets

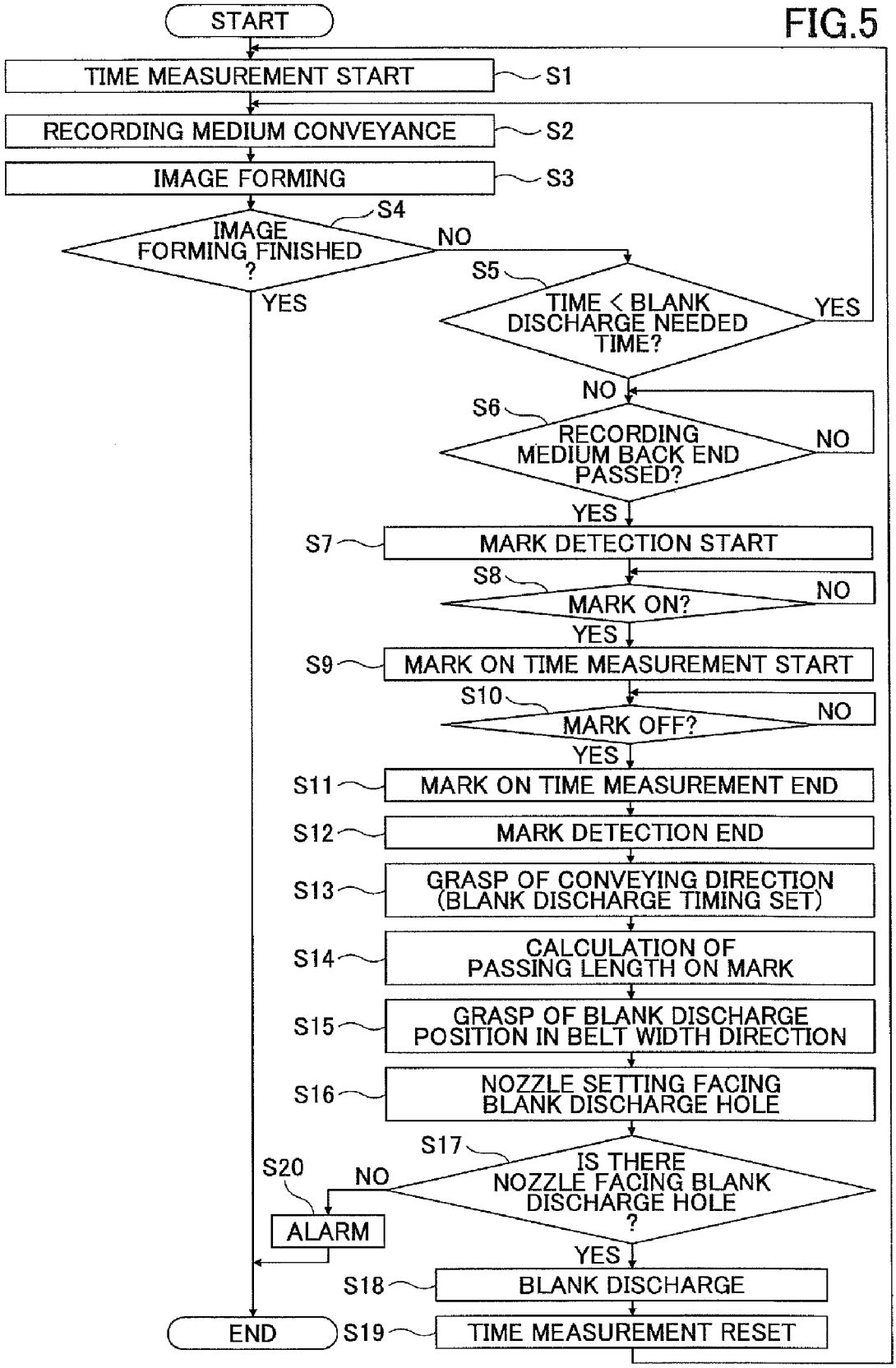
FIG.5
START
TIME MEASUREMENT START
S1
RECORDING MEDIUM CONVEYANCE
S2
IMAGE FORMING
S3
S4
IMAGE FORMING FINISHED ?
NO
YES
S5
TIME < BLANK DISCHARGE NEEDED TIME?
YES
NO
S6
RECORDING MEDIUM BACK END PASSED?
NO
YES
S7
MARK DETECTION START
S8
MARK ON?
NO
YES
S9
MARK ON TIME MEASUREMENT START
S10
MARK OFF?
NO
YES
S11
MARK ON TIME MEASUREMENT END
S12
MARK DETECTION END
S13
GRASP OF CONVEYING DIRECTION (BLANK DISCHARGE TIMING SET)
S14
CALCULATION OF PASSING LENGTH ON MARK
S15
GRASP OF BLANK DISCHARGE POSITION IN BELT WIDTH DIRECTION
S16
NOZZLE SETTING FACING BLANK DISCHARGE HOLE
S17
IS THERE NOZZLE FACING BLANK DISCHARGE HOLE ?
S20
NO
ALARM
YES
S18
BLANK DISCHARGE
END
S19
TIME MEASUREMENT RESET

IMAGE FORMING APPARATUS

BACKGROUND OF THE INVENTION

1. Field of the Invention

The present invention relates to image forming apparatuses. More specifically, the present invention relates to an image forming apparatus such as a duplicating machine, facsimile apparatus and printer.

2. Description of the Related Art

Conventionally, an ink-jet type image forming apparatus is known. The ink-jet type image forming apparatus discharges an ink droplet from a nozzle of a liquid discharge head that is an ink discharge unit, and forms an image on a recording medium. One of this kind of ink-jet type image forming apparatuses forms an image by using a line head including nozzles arranged along a width direction across the full width of the recording medium. The ink-jet type image forming apparatus has a risk that as ink solvent evaporates from the nozzle, ink viscosity of the nozzle increases, clogging occurs, a normal ink discharge is prevented, and thus, an image failure occurs. Because of this, it is necessary to discharge the ink with increased viscosity from the nozzle by performing a blank discharge at regular intervals.

Japanese Laid-Open Patent Application Publication No. 2005-225207 and Japanese Laid-Open Patent Application Publication No. 2006-159556 disclose the following ink-jet type image forming apparatus. That is, the image forming apparatus includes a conveyor belt to convey a recording medium, including a plurality of blank discharge holes through which ink passes for a blank discharge, and performs a blank discharge toward the blank discharge holes from nozzles in a line head. The ink discharged from the line head by the blank discharge passes through the blank discharge holes of the conveyor belt. The image forming apparatus collects the ink in a blank discharge receiver provided facing the line head through the conveyor belt.

The conveyor belt is configured to rotate by being supported by a plurality of supporting rollers including a driving roller and a driven roller. Such a configuration of conveyor belt sometimes moves in a belt width direction, according to a belt state, physical environment in the device, installation condition and so on. If the conveyor belt moves in the belt width direction, positions of the blank discharge holes set at the conveyor belt become out of alignment in the belt width direction. As a result, some of the nozzles set to perform the blank discharge toward a certain blank discharge hole do not face the blank discharge hole, and the ink of the blank discharge adheres to the conveyor belt. If the ink adheres to the conveyor belt, a surface of the recording medium in contact with the conveyor belt becomes tainted by the ink adhered to the conveyor belt. Moreover, while fixing a paper jam, an operator sometimes touches the conveyor belt, which may soil the operator's clothes.

SUMMARY OF THE INVENTION

Accordingly, embodiments of the present invention may provide a novel and useful image forming apparatus solving or reducing one or more of the above-described problems.

More specifically, the embodiments of the present invention may provide an image forming apparatus whereby ink adhesion to a conveyor belt in a blank discharge can be reduced.

According to one embodiment of the present invention, an image forming apparatus is provided, the apparatus including:

an ink discharge unit including a plurality of nozzles to discharge ink and to form an image on a recording medium by discharging the ink from the plurality of nozzles onto the recording medium;

a conveyer belt to convey the recording medium so that the recording medium passes through an area facing the ink discharge unit, the conveyor belt including a plurality of blank discharge holes to let the ink for a blank discharge from the ink discharge unit through;

a control unit to control an ink discharge operation of the ink discharge unit;

a blank discharge receiver to receive the ink for the blank discharge discharged from the ink discharge unit, provided at a position facing the ink discharge unit across the conveyor belt; and a belt position detection unit to detect a position in a direction perpendicular to a belt moving direction of the conveyor belt, wherein the control unit controls the blank discharge operation of the ink discharge unit based on a detection result detected by the belt position detection unit.

Other objects, features and advantages of the present invention will become more apparent from the following detailed description when read in conjunction with the accompanying drawings.

BRIEF DESCRIPTION OF THE DRAWINGS

FIG. 5 is a control flow diagram of an image forming operation in the ink-jet printer in the embodiment of the present invention;

DETAILED DESCRIPTION OF THE PREFERRED EMBODIMENTS

A description is given, with reference to the accompanying drawings, of embodiments of the present invention. As an embodiment of an ink-jet type image forming apparatus to which the present invention is applied, an ink-jet printer is explained hereinafter.

Figure 1:
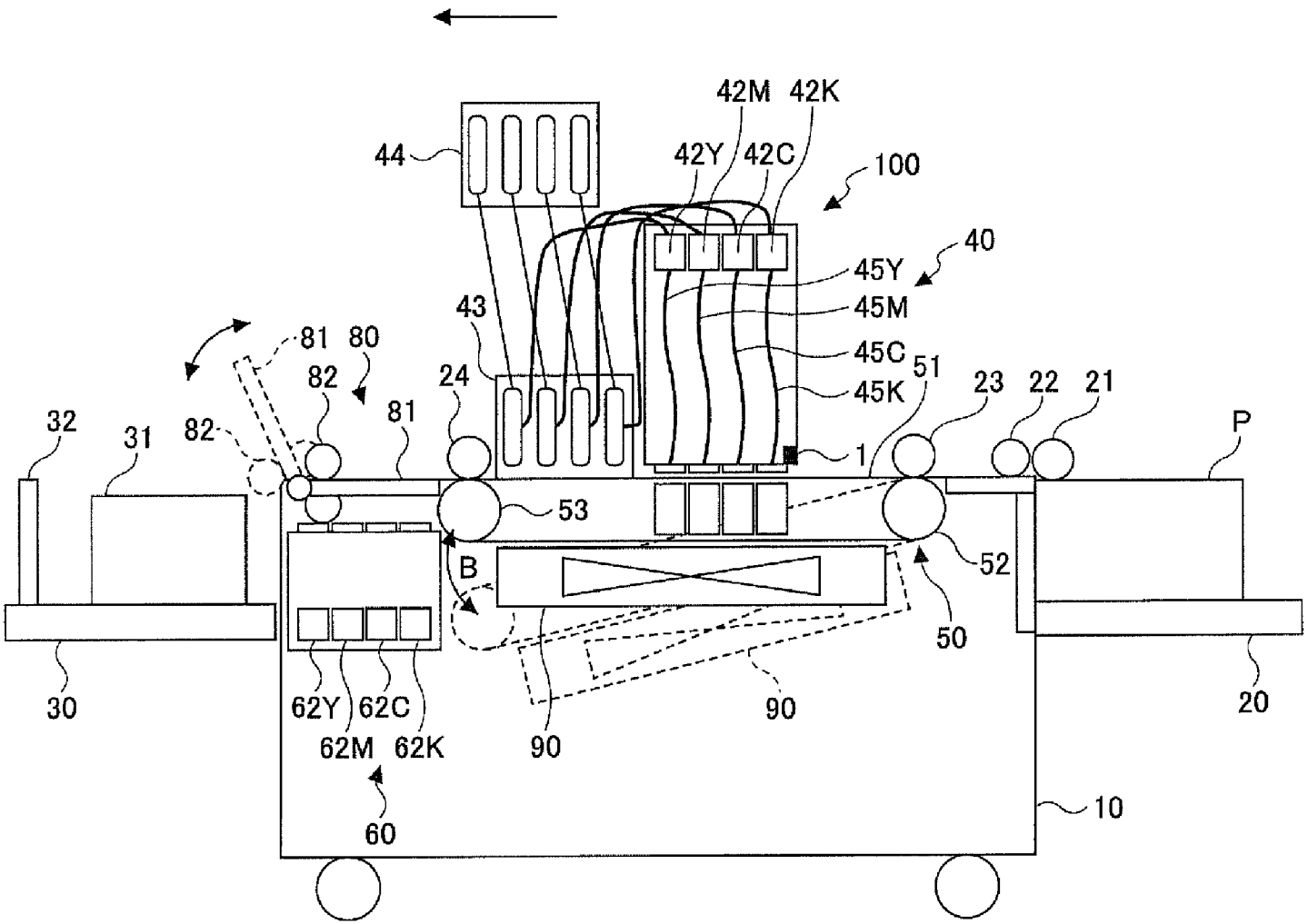
FIG. 1 is an outline elevation view of an ink-jet printer in an embodiment of the present invention.
Figure 2:
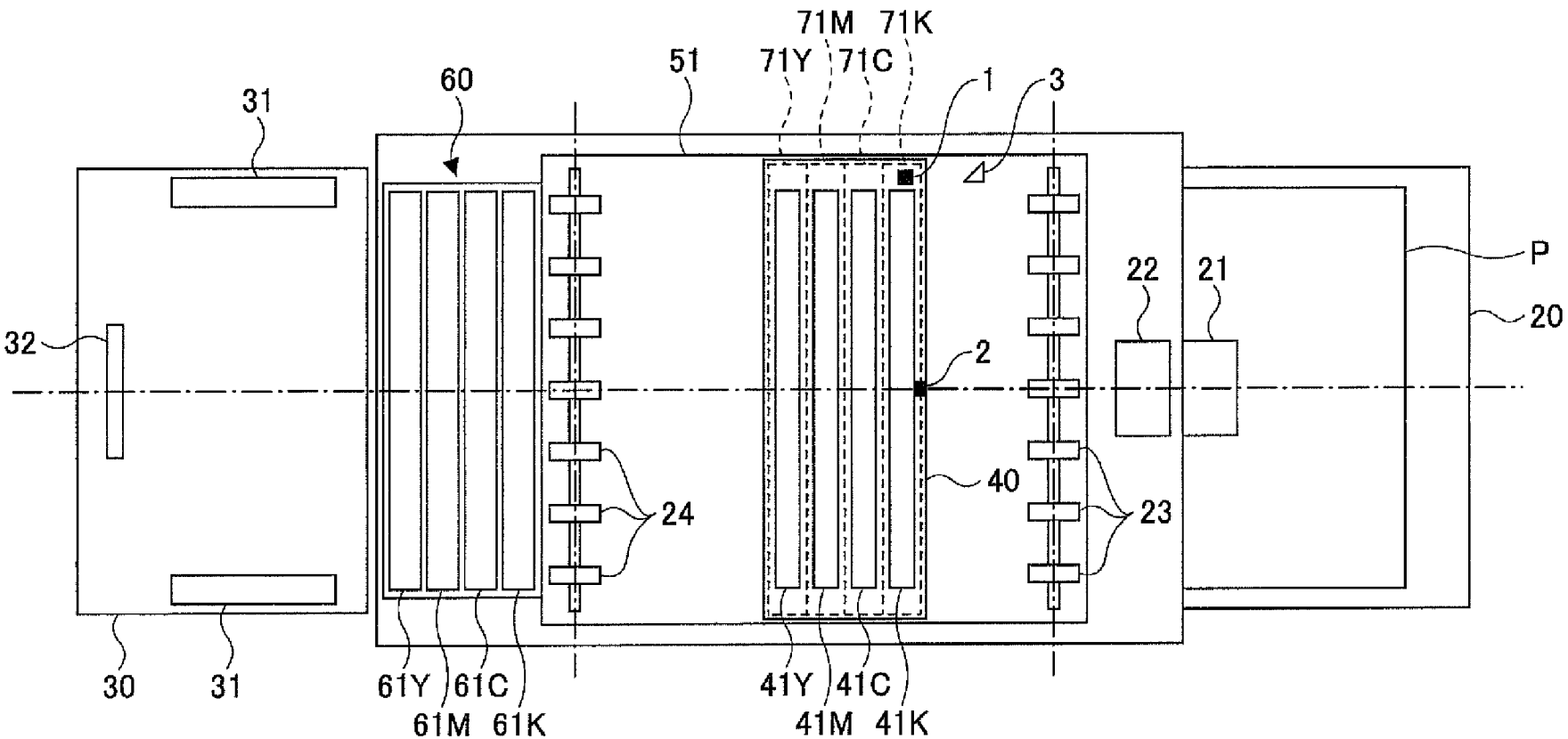
FIG. 2 is an outline top view of the ink-jet printer in the embodiment of the present invention.

FIG. 1 is an outline elevation view of an ink-jet printer 100. FIG. 2 is an outline top view of the ink-jet printer 100. In FIG. 2, a paper ejection guide part 80 is not shown.

The ink-jet printer 100 includes an apparatus main body 10 including a medium tray 20 that piles and feeds a recording medium P, a catch tray 30 that catches and piles a printed recording medium P, a conveyance part 50 that conveys the recording medium P from the medium tray 20 to the catch tray 30, and so on. A head part 40, a sub-tank 43, and a main tank 44 are provided at the upper part of the apparatus main body 10.

As shown in FIG. 2, the head part 40 includes liquid discharge heads 41Y, 41M, 41C, 41K that constitute an ink discharge unit that respectively discharges ink of yellow (Y), magenta (M), cyan (C) and black (B), arranged in a recording medium moving direction. Each of liquid discharge heads 41Y, 41M, 41C, 41K is configured to be a line head in which nozzles are arranged along a width direction of the recording medium P across the full width of the recording medium P. A configuration of the head part 40 is not limited to the embodiment. For example, a plurality of liquid discharge heads that discharge the same color ink may be arranged in a line in the width direction of the recording medium P, or may be arranged in a zigzag formation. As shown in FIG. 1, in the upper part of the head part 40, branch pipes 42Y, 42M, 42C, 42K to provide liquid ink for each color of the liquid discharge heads 41Y, 41M, 41C, 41K are provided corresponding to each of the liquid discharge heads 41Y, 41M, 41C, 41K. Conveyance tubes 45Y, 45M, 45C, 45K are respectively connected to the branch pipes 42Y, 42M, 42C, 42K. The other ends of the conveyance tubes 45Y, 45M, 45C, 45K are respectively connected to the liquid discharge heads 41Y, 41M, 41C, 41K, shown in FIG. 2. The sub-tank 43 is arranged on the upstream side of the branch pipes 42Y, 42M, 42C, 42K in a liquid ink moving direction. A water level difference between the sub-tank 43 and the liquid discharge heads 41Y, 41M, 41C, 41K allows meniscus of the nozzles of the liquid discharge heads 41Y, 41M, 41C, 41B to maintain appropriate negative pressure to hold the ink. Furthermore, the main tank 44 that stores the ink is arranged on the upstream side in the liquid ink moving direction as compared to the sub-tank 43. The branch pipes 42Y, 42M, 42C, 42K and sub-tank 43 are connected by the conveyance tubes 45Y, 45M, 45C, 45K. The sub-tank 43 and main tank 44 are also connected by the conveyance tubes 45Y, 45M, 45C, 45K. The head part 40 can slide and move to an upper part of a head cleaning device 60 described below.

The apparatus main body 10 is composed of side panels of front and back and stays, and includes the conveyance part 50, the head cleaning device 60, a suction fan 90, and blank discharge receivers 71Y, 71M, 71C, 71K inside.

Figure 6:
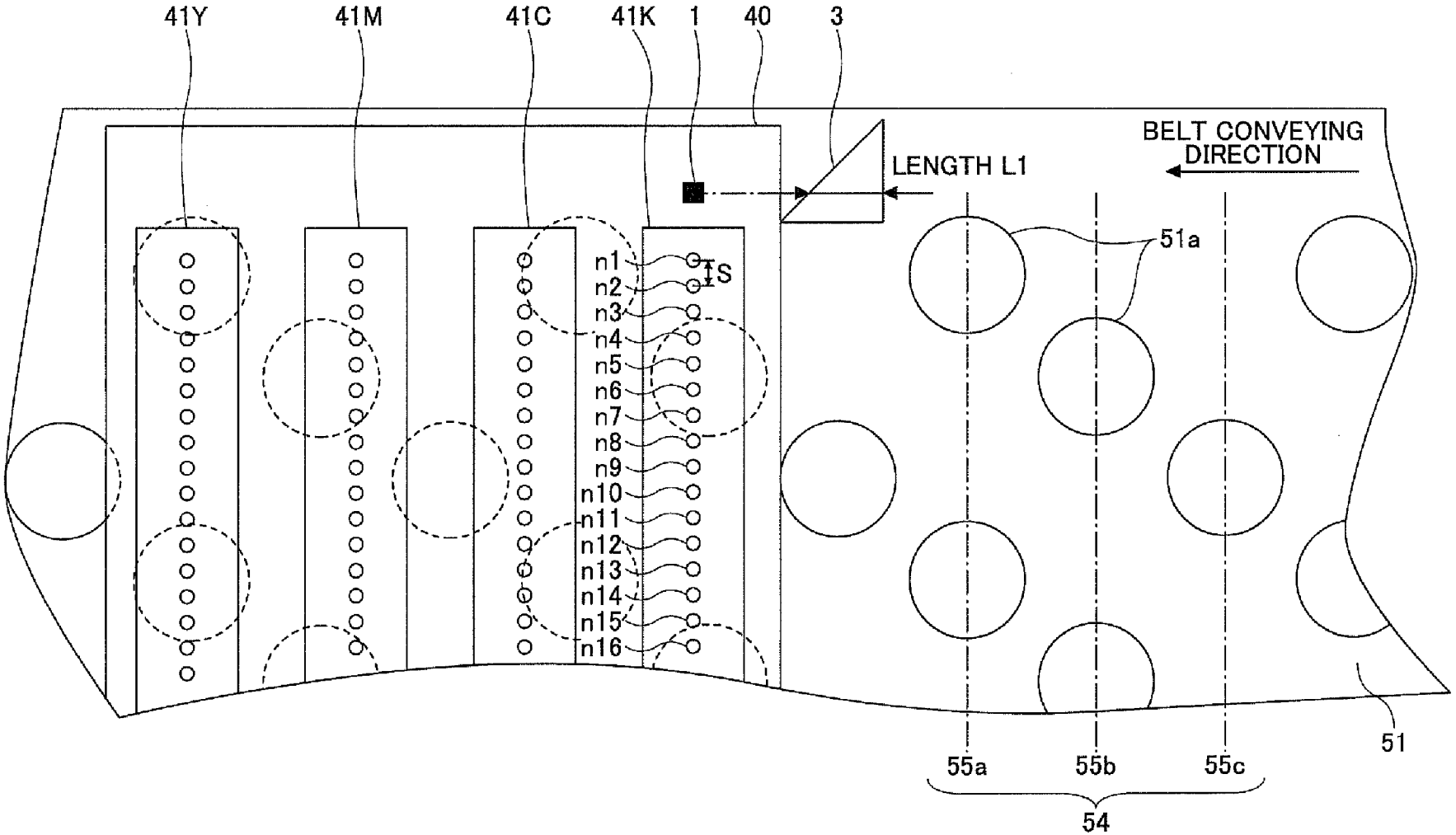
FIG. 6 is an outline configuration diagram in the vicinity of a mark detection sensor in the embodiment of the present invention.

The conveyance part 50 includes an endless band-like conveyor belt 51. The conveyor belt 51 is hung and wound around a driving roller 53 and a driven roller 52 in an appropriate tension. As shown in FIG. 6, the conveyor belt 51 includes a first suction hole array 55*a* including a plurality of suction holes 51*a* arranged in a line in the belt width direction, a second suction hole array 55*b* provided on the upstream side of the first suction hole array 55*a* including a plurality of suction holes 51*a* arranged in a line in the belt width direction, and a third suction hole array 55*c* provided on the upstream side of the second suction hole array 55*b* including a plurality of suction holes 51*a* arranged in a line in the belt width direction. The first suction hole array 55*a*, the second suction hole array 55*b* and the third suction hole array 55*c* constitute a suction hole group 54, and a plurality of suction hole groups 54 are provided in the conveyor belt 51 in the belt moving direction. Positions of the suction holes 51*a* of the first, second and third suction hole arrays 55*a*, 55*b*, 55*c* differ from each other in the belt width direction.

As shown in FIG. 1, the driving roller 53 is rotated and driven at a predetermined speed by a driving motor (which is not shown in FIG. 1), which causes the conveyor belt 51 also to rotate at a predetermined speed. In addition, the conveyance part 50 includes an entrance guide roller 23 that presses the recording medium P to the conveyor belt 51 at a position facing the driven roller 52. As shown in FIG. 2, a plurality of entrance guide rollers 23 and exit guide rollers 24 are provided in the width direction of the recording medium P, and are supported by guide members (which are not shown in FIG. 2) at both ends of roller axes of the guide rollers 23, 24, by being hung using their own weight. As shown in FIG. 1, the conveyance part 50 is supported by the apparatus main body 10 capable of turning in a downward direction of arrow B by making the driven roller 52 a supporting point.

As shown in FIG. 1, a suction fan 90 is provided at a lower part of the conveyance part 50. The suction fan 90 suctions the recording medium P proceeding into the conveyor belt 51 from the medium tray 20 and absorbs the recording medium P on a surface of the conveyor belt 51. The suction fan 90 is supported by the conveyance part 50, and as shown in FIG. 1 by dotted lines, is capable of turning with the conveyance part 50 together. In addition, as shown in FIG. 2, four blank discharge receivers 71Y, 71M, 71C, 71K are provided, facing each of the liquid discharge heads 41Y, 41M, 41C, 41K across the conveyor belt 51. As discussed in more detail below, an ink droplet discharged from each of the liquid discharge heads 41Y, 41M, 41C, 41K for the blank discharge passes through the suction hole 51*a* of the conveyor belt 51, and falls to the blank discharge receivers 71Y, 71M, 71C, 71K. More specifically, in the embodiment, the suction hole 51*a* to suction the recording medium P on the conveyor belt 51 also functions as a blank discharge hole to pass the ink droplet for the blank discharge.

As shown in FIG. 1, a paper ejection guide part 80 is provided on the left side of the conveyance part 50 (which is downstream in the recording medium moving direction). The paper ejection guide part 80 includes a paper ejection guide plate 81 and a pair of paper ejection rollers 82. The paper ejection guide plate 81 guides the recording medium P, facing an opposite surface of an image forming surface of the recording medium P. The pair of paper ejection rollers 82 is supported by the paper ejection guide plate 81. An end of the paper ejection guide plate 81 is supported by the apparatus main body 10, rotatably to the apparatus body 10.

A head cleaning device 60 is provided below the paper ejection guide part 80. The head cleaning device 60 includes four caps 61Y, 61M, 61C, 61K to cap four liquid discharge heads 41Y, 41M, 41C, 41K respectively. Each of the caps 61Y, 61M, 61C, 61K includes a suction hole (which is not shown in FIG. 1), and suction pumps 62Y, 62M, 62C, 62K are connected to the suction holes. Moreover, the head cleaning device 60 includes a wiper blade (which is not shown in FIG.

1) to wipe a nozzle surface. The wiper blade is provided to clean up liquid ink adhered to the nozzle surface.

When an image is not formed, the paper eject guide part 80 lies at a position expressed by dotted lines in FIG. 1, the conveyance part 50 and suction fan 90 also lie at a position expressed by dotted lines. Furthermore, the head part 40 lies at a position facing the head cleaning device 60, and the caps 61Y, 61M, 61C, 61K of the head cleaning device 60 cap nozzle surfaces of the liquid discharge heads 41Y, 41M, 41C, 41K, and maintain moist conditions at the nozzles. The head cleaning device 60 has a function that sucks bubbles and/or dirt adhered to the nozzle with the ink by the suction pump, in a state where the nozzle is capped, and improves a poor discharge.

In addition, as shown in FIG. 2, a back end detection sensor 2, a back end detection unit to detect a back end of the recording medium P, is provided upstream to the liquid discharge head 41K in the recording medium moving direction, and in the center in the head part width direction. Here the liquid discharge head 41K works as a block color head of the head part 40. For example, a reflection-type optical sensor is available for the back end detection sensor. The conveyor belt 51 is formed to be black that absorbs light. When the conveyor belt 51 is in a detection area (i.e., light irradiation area) of the back end detection sensor 2, the back end detection sensor 2 does not detect light because the conveyor belt 51 hardly emits reflective light.

On the other hand, because the recording medium P is generally white, the back end detection sensor 2 detects reflective light when the recording medium P is in the detection area of the back end detection sensor 2. As a result, when the back end detection sensor 2 switches from a reflective light detecting state to a non reflective light detecting state, it is possible to detect that the back end of the recording medium P passes through the back end detection sensor 2.

Moreover, as shown in FIG. 2, a mark detection sensor 1, a mark detection unit that detects a belt position detection mark 3 provided at a non-facing part that does not face an ink discharge area on the conveyor belt 51, is provided in a back end of the head part 40 (which means upper part in FIG. 2). The belt position detection mark 3 is made of a member that reflects light, and is attached on an end of the conveyor belt 51. The mark detection sensor 1 is a reflection-type optical sensor. The mark detection sensor 1 does not detect reflective light when facing the conveyor belt 51. The mark detection sensor 1 detects the reflective light when facing the belt position detection mark 3 because the belt position detection mark 3 reflects light emitted from the mark detection sensor 1. Due to this, the mark detection sensor 1 can detect the belt position detection mark 3.

Figure 3:
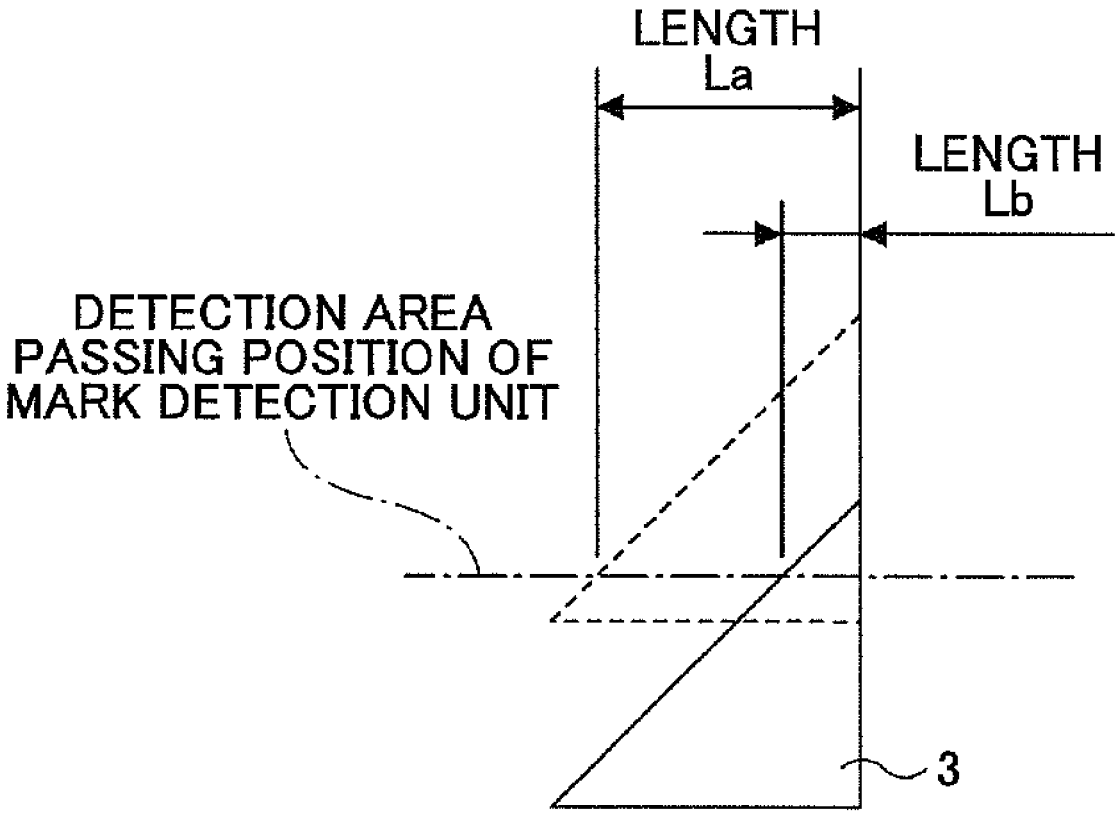
FIG. 3 is an illustration diagram to illustrate that a length of a belt position detection mark in a belt moving direction that passes through a mark detection area of a mark detection sensor differs depending on a position in a belt width direction of a conveyor belt.

As shown in FIG. 3, the belt position detection mark 3 has a rectangular triangle shape, whose hypotenuse is at a downstream side in a conveyor belt moving direction, and the mark detection sensor 1 detects the belt position detection mark 3 from the hypotenuse. By making the belt position detection mark 3 a triangle shape, a belt moving length of the belt position detection mark 3 differs in a direction perpendicular to the belt moving direction (which may be hereinafter called "a belt width direction"). Accordingly, when the mark detection sensor 1 detects the belt position detection mark 3, a position in the belt width direction of the conveyor belt 51 can be detected. More specifically explained, as shown in FIG. 3, when a position in the belt width direction of the conveyor belt 51 is in a certain position, a length of the belt position detection mark 3 in the belt moving direction passing a mark detection area of the mark detection sensor 1 is Lb. On the other hand, if the position in the belt width direction of the conveyor belt 51 is shifted upward in FIG. 3, the belt position detection mark is shifted upward 3 on the conveyor belt 51 as shown by dotted lines in FIG. 3. Then, a length in the belt moving direction of the belt position detection mark 3 passing the mark detection area of the mark detection sensor 1 becomes La, which is longer than Lb. As a result, a time when the mark detection sensor 1 continuously detects the belt position detection mark 3 becomes longer if the position in the belt width direction is shifted upward in FIG. 3.

Therefore, by measuring a mark detection time by the mark detection sensor 1, the position of the conveyor belt 51 in the belt width direction can be detected. In other words, the belt position detection mark 3, the mark detection sensor 1 and a measurement unit that measures a mark detection time of the mark detection sensor 1 function as a belt position detection unit.

Furthermore, by shaping a side of the belt position detection mark 3 upstream of the belt moving direction of to be perpendicular to the belt moving direction, a position in the belt moving direction of the conveyor belt 51 can be detected based on a detection result of the belt position detection mark 3 by the mark detection sensor 1. Also, as described below, a starting time of a blank discharge can be controlled based on a time when the mark detection sensor 1 switches from a state detecting the belt position detection mark to a non-detecting state.

Figure 4:
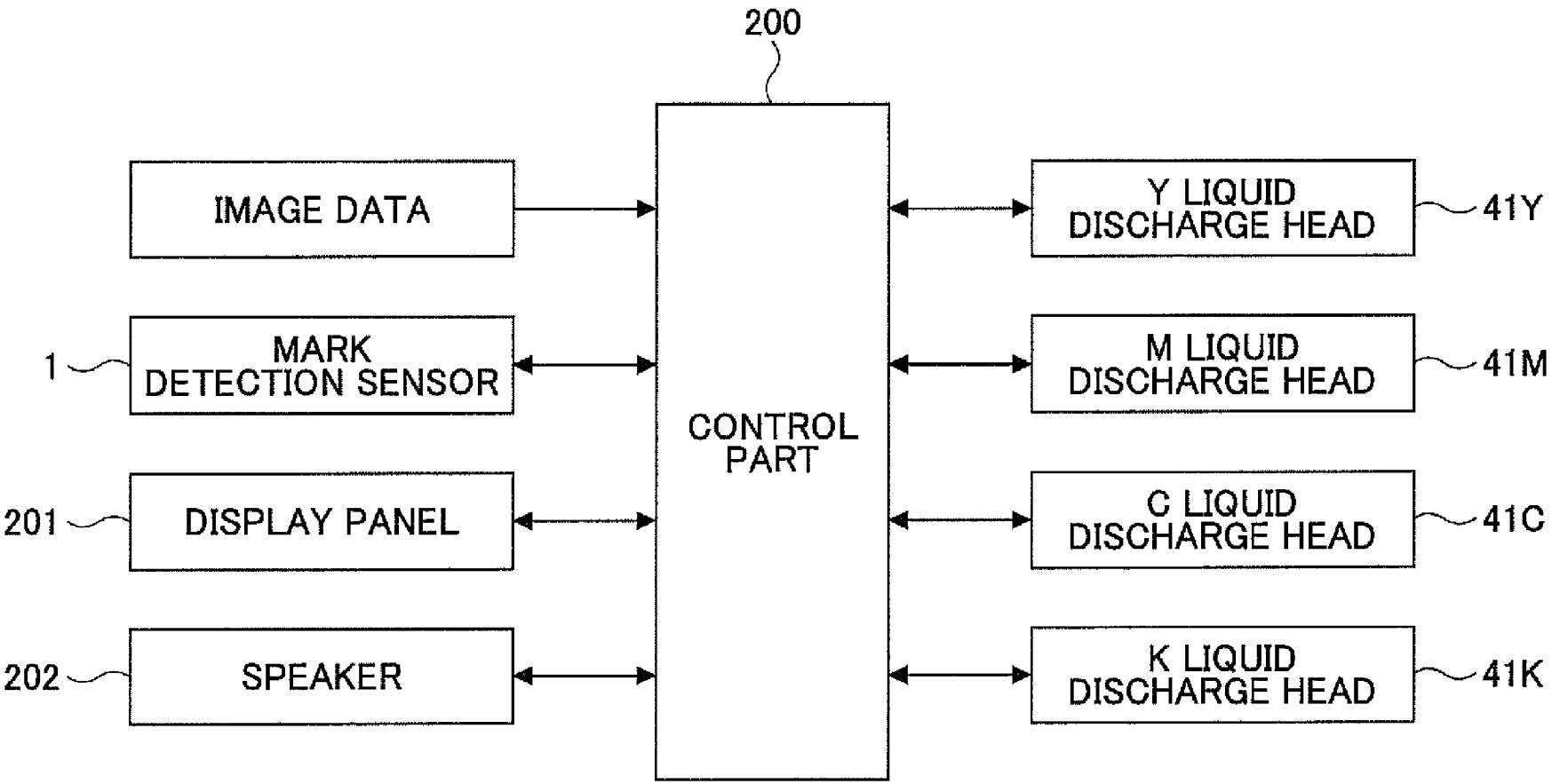
FIG. 4 is a control block diagram of the ink-jet printer in the embodiment of the present invention.

FIG. 4 is a block diagram of the ink-jet printer of the embodiment.

In FIG. 4, a control part 200 includes a CPU (i.e., Central Processing Unit) of a computing unit, a RAM (i.e., Random Access Memory) of a nonvolatile memory, a ROM (i.e., Read only Memory) of a temporary storage unit, and so on. The control part 200 controls all of the apparatus (i.e., the printer 100 in the embodiment). Various devices and sensors are connected to the control part 200. However, FIG. 4 shows only devices and sensors related to features of the printer 100. The control part 200 realizes a function of each unit based on a control program stored in the RAM. More specifically, the control part 200 functions as a control unit that controls ink discharge of each of the liquid discharge heads 41Y, 41M, 41C, 41K, based on image data. In addition, the control part 200 also functions as a measurement unit that measures the mark detection time, since the mark detection sensor 1 begins to detect the belt position detection mark 3 to the end. Moreover, the control part 200 also has a function that finds a position of the conveyor belt 51 in the belt width direction based on the mark detection time, and controls a blank discharge of each of the liquid discharge heads 41Y, 41M, 41C, 41K.

Furthermore, the control part 200 functions as a determination unit that determines if the found position of the conveyor belt 51 in the belt width direction is out of alignment more than a predetermined distance from a baseline, and there is a nozzle not facing any suction holes 51*a*. In addition, a display panel 201 shows information such as textual information, controlled by the control part 200. Moreover, a speaker 202 outputs sound based on a control signal from the control part 200.

Next, an explanation is given about an image forming operation of the ink-jet printer 100 in the embodiment.

FIG. 5 shows a control flow of an image forming operation.

When the ink-jet printer 100 receives image data of image information from an external device such as a personal computer (which is not shown in drawings) through a communication cable, the head cleaning device 60 descends, and as shown in FIG. 1, the head part 40 moves to an ink discharge area facing the blank discharge receiver 71Y, 71M, 71C, 71K across the conveyor belt 51. When the head part 40 moves to the ink discharge area, the conveyance part 50 and suction fan 90 turn from a position of dotted lines to a position of solid lines, and the conveyance guide part 80 turns from a position of dotted lines to a position of solid lines.

Next, as shown in FIG. 5, a time measurement starts in step S1, and a recording medium P on the medium tray 20 is conveyed to an ink discharge area in step S2. More specifically, the paper feeding roller 21 starts to rotate, and pulls a top recording medium P of a recording medium block piled on the medium tray 20 to a separating roller 22. The recording medium P pulled out from the medium tray 20 by the paper feeding roller 21 is separated into one recording medium P by the separating roller 23, and conveyed to the conveyance part 50. The recording medium P conveyed to the conveyance part 50 is pressed to the conveyor belt 51 by the entrance guide roller 23. The recording medium P on the conveyor belt 51 is absorbed on a surface of the conveyor belt 51 by the suction fan 90, and is conveyed by an endless rotation of the conveyor belt 51.

When the recording medium P is carried to an ink discharge area, the control part 200 acts as a control unit and controls each of the liquid discharge heads 41Y, 41M, 41C, 41K based on the image data, makes a predetermined nozzle discharge an ink droplet, and forms an image on the recording medium P, as shown in step S3. The conveyor belt 51 conveys the recording medium P on which the image is formed to the paper ejection guide part 80. The pair of ejection rollers 82 in the paper ejection guide part 80 ejects the recording medium P to an area surrounded by an end fence 32 and a side fence 31.

Next, in step S4, it is checked if an image forming operation is finished. If the image forming operation is finished, in case of "YES" in step S4, the conveyance part 50 turns to a position expressed by dotted lines in FIG. 1 with suction fan 90. Moreover, the paper ejection guide part 80 turns to a position expressed by dotted lines in FIG. 1. Then, the head part 40 moves to a position facing the head cleaning device 60, the head cleaning device 60 moves upward, the caps 61Y, 61M, 61C, 61K cap the liquid discharge heads 41Y, 41M, 41C, 41K respectively, and the image forming operation finishes.

Furthermore, if a discharge failure occurs and it causes an image failure, performing a nozzle cleaning is commanded by the ink-jet printer user's operation and so on. When the control part 200 receives a nozzle cleaning signal, after capping nozzle surfaces of the liquid discharge heads 41Y, 41M, 41C, 41K with the caps 61Y, 61M, 61C, 61K, the control part 200 drives the suction pumps 62Y, 62M, 62C, 62K to suction bubbles and dirt adhered to the nozzles with ink, and improves the discharge failure. After improving the discharge failure, the control part 200 moves the caps 61Y, 61M, 61C, 61K from the nozzle surfaces. Then, the control part 200 moves a wiper blade (which is not shown in FIG. 1) upward, and moves head part 40 to the ink discharge area. With this, the wiper blade wipes the surfaces of the nozzles of the liquid discharge heads 41Y, 41M, 41C, 41K, and the nozzle surfaces are cleaned. After the nozzle surfaces are cleaned, the head part 40 moves again to the area facing the head cleaning device 60, the nozzle surfaces of the liquid discharge heads 41Y, 41M, 41C, 41K are capped with the caps 61Y, 61M, 61C, 61K.

On the other hand, if there is the next image data, in case of "NO" in step S4, it is checked whether the measurement time which started at the beginning of the image forming process is less than a necessary blank discharge time in step S5. In step S5, if the measurement time is less than the necessary blank discharge time, in case of "YES" in step S5, the next image forming operation is performed as shown in step S2 to S4. In contrast, if the measurement time is greater than or equal to the necessary blank discharge time, in case of "NO" in step S5, there is a concern that ink viscosity of a nozzle that has not discharged ink during the image forming increases more than that of a nozzle that has discharged ink, because of evaporation of ink solvent. Hence, if the measurement time is greater than or equal to the necessary blank discharge time, in case of "NO" in step S5, a blank discharge control is performed.

In step S6, to begin with, if the back end detection sensor 2 detects passing of a back end of the recording medium P, in case of "YES" in step S6, the mark detection sensor 1 starts detection of the belt position detection mark 3 in step S7. When the mark detection sensor 1 detects the hypotenuse of the belt position detection mark 3, and the control part 200 receives an ON signal from the mark detection sensor 1, in case of "YES" in step S8, the control part 200 starts a time measurement as shown in step S9. Then, if the belt position detection mark 3 passes a mark detection area of the mark detection sensor 1, and the signal from the mark detection sensor 1 turns from the ON signal to an OFF signal, in case of "YES" in step S10, the control part 200 finishes the time measurement as shown in step 11. In step S12, the control part 200 stops the belt position detection mark detecting process by the mark detection sensor 1.

Next, in step S13, the control part 200 sets a blank discharge start timing based on a timing when the signal from the mark detection sensor 1 turns from the ON signal to the OFF signal. As shown in FIG. 3, a side of the mark position detection mark 3 upstream in the belt moving direction is perpendicular to the belt moving direction. As a result, as shown in FIG. 6, even if a position of the conveyor belt 51 is shifted in the belt width direction, a distance from the side of the belt position detection mark 3 upstream in the belt moving direction to each of the suction holes 51*a* does not change. Thus, even if the position of the conveyor belt 51 is shifted in the belt width direction, the signal from the mark detection sensor 1 turns from the ON signal to the OFF signal, and a suction hole 51*a* faces the liquid discharge head 41Y, 41M, 41C, 41K at a predetermined elapse timing.

Therefore, by controlling a start of the blank discharge based on the timing when the signal from the mark detection sensor 1 turns from the ON signal to the OFF signal, the blank discharge can be performed at a timing when the suction hole 51*a* faces the liquid discharge head 41Y, 41M, 41C, 41K. In the embodiment, upstream to the belt position detection mark 3 in the belt moving direction, the suction hole 51*a* of the nearest suction hole group 54 is used as the blank discharge hole. In the embodiment, a diameter of the suction hole 51*a* is more than 4S and less than or equal to 5S if a distance between nozzles is made S, which allows one suction hole 51*a* to let ink droplets for the blank discharge from a maximum of four nozzles through. In addition, the distance between nozzles and the diameter of the suction holes are not limited to the embodiment. The number of the nozzles that discharge a droplet to one suction hole 51*a* varies in accordance with a relation to the distance between nozzles or the diameter of the suction hole 51*a*. Moreover, an area forming the suction hole 51*a* is wider in the belt width direction than an area to which the liquid discharge heads 41Y, 41M, 41C, 41K can discharge an ink droplet, so that all of the nozzles can face any suction hole 51*a* and can perform the blank discharge, even if the conveyor belt 51 moves in the belt width direction to some extent.

Next, in step S14, the control part 200 calculates a length of the belt position detection mark 3 in the belt moving direction that has passed the mark detection area of the mark detection sensor 1, based on the time the control part 200 received an ON signal from the mark detection sensor 1. Next, in step S15, the control part 200 determines a position of the conveyor belt 51 in the belt width direction based on a length of the belt position detection mark 3 in the belt width direction, and determines a position of a suction hole 51*a* used as the blank discharge hole in the belt width direction. Then, in step S16, the control part 200 sets a nozzle that discharges ink to a suction hole 51*a* of the first suction hole array 55*a*, a nozzle that discharges ink to a suction hole 51*a* of the second suction hole array 55*b* and a nozzle that discharges ink to a suction hole 51*a* of the second suction hole array 55*c*, based on the determined position of the suction hole 51*a* in the belt width direction. More specifically, the control part 200 calculates a difference value between a reference length L1 of the belt position detection mark 3 in the belt moving direction and the calculated length of the belt position detection mark 3 in the belt moving direction, and calculates a moving distance D from a reference position of the conveyor belt 51 in the belt width direction based on the difference value. Next, the control part 200 identifies nozzle setting data to control the blank discharge based on the calculated moving distance.

More specifically described, for example, as shown in FIG. 6, if the calculated length L of the belt position detection mark 3 in the belt moving direction is the reference length L1, a difference value between the reference length L1 of the belt position detection mark 3 in the belt moving direction and the calculated length L of the belt position detection mark 3 in the belt moving direction is zero, and the moving distance D of the conveyor belt 51 in the belt width direction from the reference position is zero. A look-up table relating nozzle setting data to the moving distance D is stored by a memory such as the RAM, and the control part 200 identifies the nozzle setting data based on the moving distance D and the look-up table. Then, the control part 200 controls each of the liquid discharge heads 41Y, 41M, 41C, 41K based on the identified nozzle setting data. When D equals zero, the nozzle setting data is set as follows. That is, when the first suction hole array 55*a* faces the liquid discharge head 41Y, 41M, 41C, 41K, the nozzles of n1, n2, n3, n12, n13, n14, n15 . . . are set to perform the blank discharge. Moreover, when the second suction hole array 55*b* faces the liquid discharge head 41Y, 41M, 41C, 41K, the nozzles of n4, n5, n6, n7, n16 . . . are set to perform the blank discharge. Furthermore, when the third suction hole array 55*c* faces the liquid discharge head 41Y, 41M, 41C, 41K, the remaining nozzles that do not yet perform the blank discharge of n8, n9, n10, n11 . . . are set to perform the blank discharge.

Figure 7:
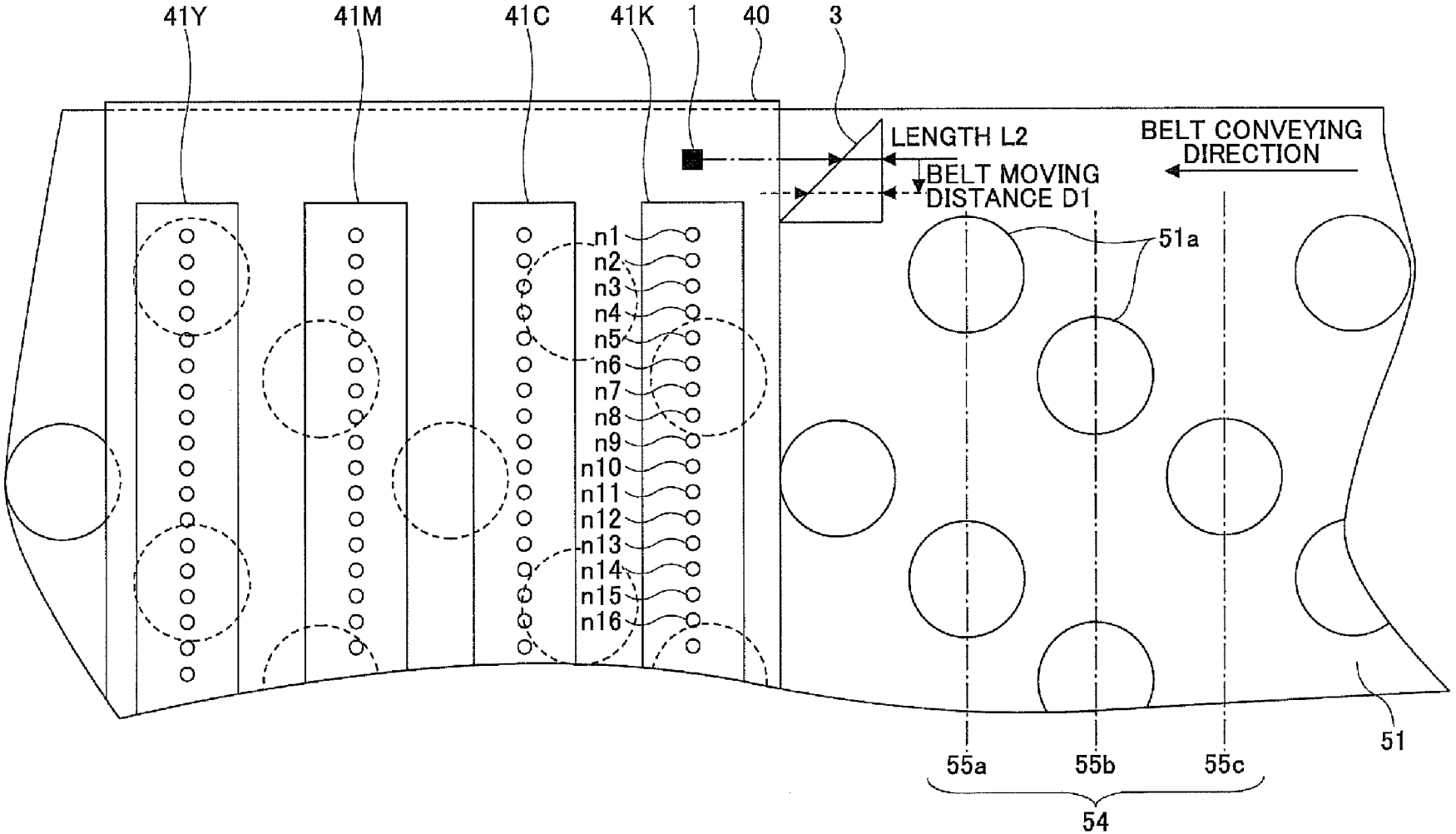
FIG. 7 is an outline configuration diagram in the vicinity of the mark detection sensor when the conveyor belt moves D1 out of alignment in the belt width direction.

On the other hand, as shown in FIG. 7, when the calculated length of the belt position detection mark 3 in the belt moving direction is L2, a difference value between the reference length L1 of the belt position detection mark 3 in the belt moving direction and the calculated length L of the conveyor belt 51 in the belt moving direction is (L2−L1), and the moving distance D of the conveyor belt 51 from the reference position in the belt width direction is calculated as D1. Thus, if a position in the belt width direction of the conveyor belt 51 moves a distance of D1 downward in FIG. 7, a position of the suction hole 51*a* in the belt width direction also moves a distance of D1 downward in FIG. 7. As a result, the nozzles of n12, . . . , n(12N) (N=a positive integer) faces a suction hole 51*a* in the third suction hole array 55*c*, and does not become to face a suction hole 51*a* in the first suction hole array. In addition, the nozzles of n4, n16, . . . , n {4+12 (N−1)} then face the first suction hole array 55*a*, and do not face the third suction hole array 55*c*. Also, the nozzles of n8, . . . , n {8+12 (N−1)} then face the first suction hole array 55*b*, and do not face the second suction hole array 55*c*. As a result, if the blank discharge control is carried out based on nozzle setting data when D equals zero, the ink droplet for the blank discharge discharged from the nozzles of n4, n8, n12, n16, . . . , n(4N) adheres to the surface of the conveyor belt 51. Hence, in this case, a nozzle setting data is set and identified based on the look-up table and the moving distance D1 as follows. That is, when the first suction hole array 55*a* faces the liquid discharge head 41Y, 41M, 41C, 41K, the nozzles of n1, n2, n3, n4, n13, n14, n15, n16, . . . , n {1+12 (N−1)}, n {2+12 (N−1)}, n {3+12 (N−1)}, n {4+12 (N−1)} are set to conduct the blank discharge. Moreover, when the second suction hole array 55*b* faces the liquid discharge head 41Y, 41M, 41C, 41K, the nozzles of n5, n6, n7, n8, . . . , n {5+12 (N−1)}, n {6+12 (N−1)}, n {7+12 (N−1)}, n {8+12 (N−1)} are set to execute the blank discharge.

Furthermore, when the third suction hole array 55*c* faces the liquid discharge head 41Y, 41M, 41C, 41K, the nozzles of n9, n10, n11, n12, . . . , n {9+12 (N−1)}, n {10+12 (N−1)}, n {11+12 (N−1)}, n {12+12 (N−1)}, n(12N) are set to perform the blank discharge.

Figure 8:
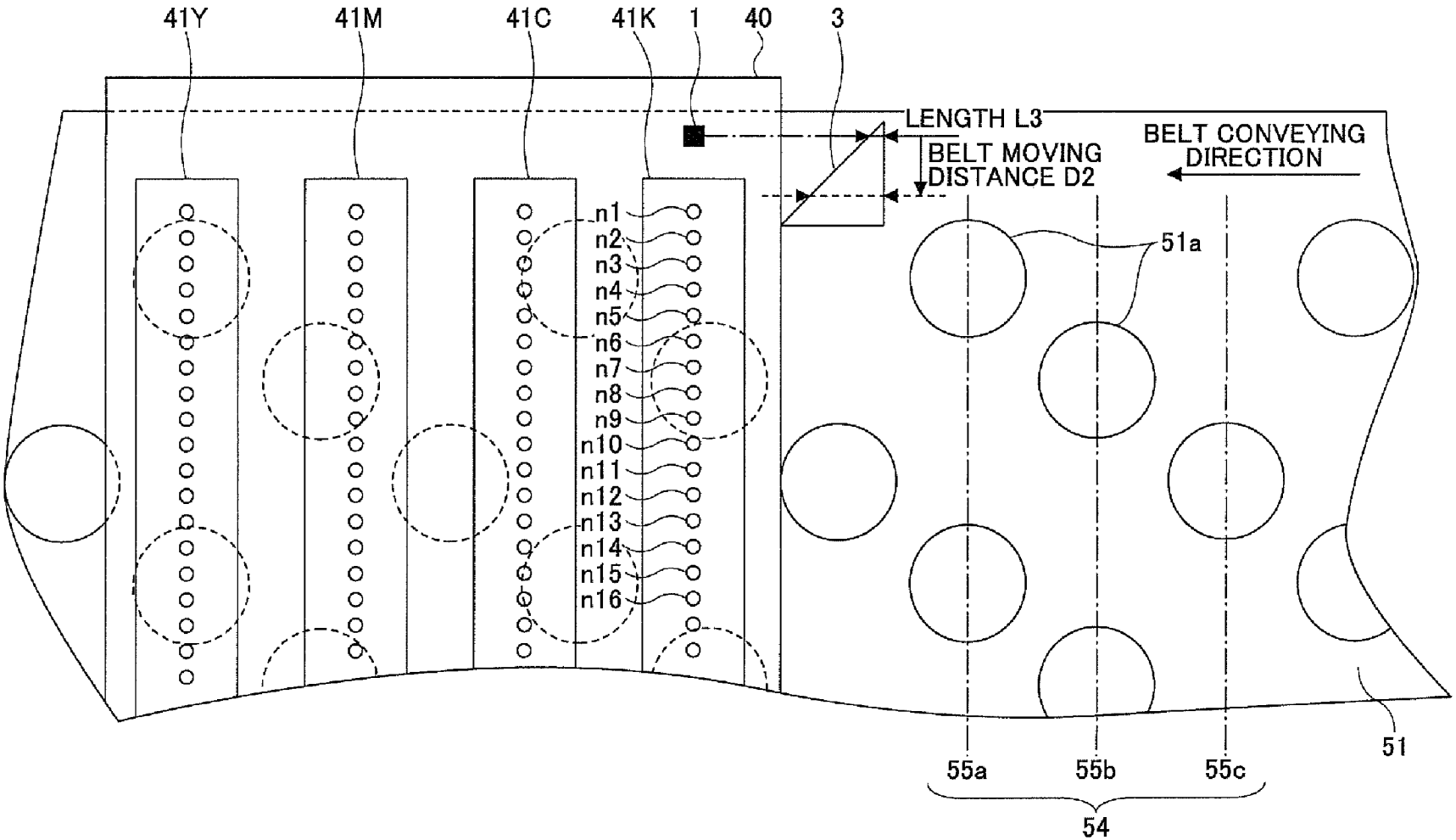
FIG. 8 is an outline configuration diagram in the vicinity of the mark detection sensor when the conveyor belt moves D2 out of alignment in the belt width direction.

In addition, as shown in FIG. 8, the nozzle n1 does not face any suction hole 51*a* and cannot carry out the blank discharge if the conveyor belt 51 widely moves downward in FIG. 8, the calculated length L of the belt position detection mark 3 in the belt moving direction becomes L3, and the moving distance D in the belt width direction of the conveyor belt 51 moves twice or more than the distance between nozzles S. As a result, viscosity of the nozzle n1 may not recover, and an image failure may occur. Thus, in this case (i.e., in case of "NO" in step S17 in FIG. 5), in order to prevent the blank discharge on the conveyor belt 51, the control part 200 raises an alarm to an operator, and stops the image forming as shown in step S20 in FIG. 5. The control part 200 raises the alarm to the operator by showing textual information of warning in the display panel 201, or by outputting a warning sound from the speaker 202.

Moreover, in the embodiment, when the moving distance D of the conveyor belt 51 in the belt width direction moves twice or more than the distance between the nozzles S, an end nozzle does not face any nozzles, but the present invention is not limited to the embodiment. If a distance from an end of the ink discharge area to an end of the suction hole formed area when the conveyor belt 51 is at the reference position shown in FIG. 6, is longer than the distance in the embodiment, even if the moving distance D of the conveyor belt 51 in the belt width direction varies twice or more than the distance between nozzles S, the end nozzle can face any suction hole 51*a*. Therefore, in that case, a moving distance D of the conveyor belt 51 in the belt width direction to stop the image forming or to raise the alarm is shorter than that in the embodiment. Thus, the moving distance D of the conveyor belt 51 in the belt width direction to stop the image forming or to raise the alarm to an operator varies depending on a relationship between the ink discharge area of the liquid discharge head 41Y, 41M, 41C, 41K and the suction hole formed area.

Furthermore, it is possible to identify the nozzle setting data based on the time when the control part 200 has received the ON signal from the mark detection sensor 1 (i.e., the mark detection time), without calculating the length of the belt position detection mark 3 in the belt moving direction. More specifically, a relationship between the mark detection time and the nozzle setting time is preliminarily examined by an experiment, and the relationship between the mark detection time and the nozzle setting data is stored as a look-up table in a memory such as the RAM. Then, corresponding nozzle setting data are identified based on the mark detection time and the look-up table, and a blank discharge control is performed based on the identified nozzle setting data.

In contrast, as shown in FIG. 6 and FIG. 7, when the length of the belt position detection mark 3 in the belt moving direction is L1, L2 and so on, and the moving distance D of the conveyor belt 51 in the belt width direction is less than twice of the distance between nozzles S, the control part 200 carries out the blank discharge of the nozzles based on the nozzle setting data at the blank discharge start timing, set at the step S13 in FIG. 5, as shown in step S18. In step S19, the time measurement is reset. Then, the image forming is conducted as shown in step S1 to S4.

Thus, in the ink-jet printer 100 of the embodiment, because the mark detection sensor 1 detects the position of the conveyor belt 51 in the belt width direction, and the blank discharge is controlled based on the detection result, ink adherence to the conveyor belt 51 is prevented. By doing this, dirtying the recording medium P by the ink adhered to the conveyor belt 51 can be prevented. In addition, it is possible to prevent dirtying an operator's hands or clothes with ink if the operator's hands or clothes touch the conveyor belt 51 while the operator fixes a paper jam.

Figure 9A:
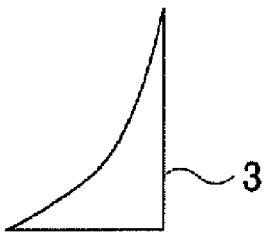
FIG. 9A is a first diagram showing another example of the belt mark detection mark in the embodiment of the present invention.
Figure 9B:
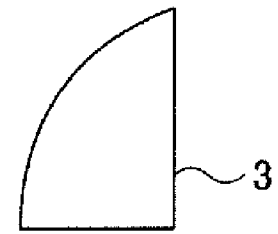
FIG. 9B is a second diagram showing another example of the belt mark detection mark in the embodiment of the present invention.
Figure 9C:
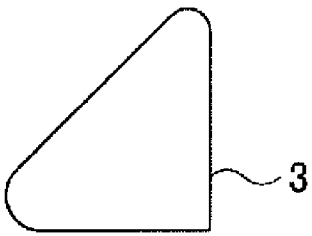
FIG. 9C is a third diagram showing another example of the belt mark detection mark in the embodiment of the present invention.
Figure 9D:
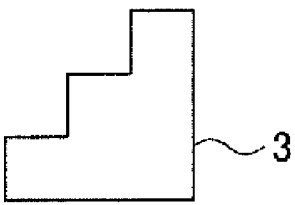
FIG. 9D is a fourth diagram showing another example of the belt mark detection mark in the embodiment of the present invention.

Moreover, in the embodiment, the belt position detection mark 3 is shaped into a triangle, and a side of the belt position detection mark 3 downstream in the belt moving direction is made an oblique line. Since the moving distance D of the conveyor belt 51 has a proportional relation to the length of the belt position detection mark 3 that has passed the mark detection area of the mark detection sensor 1, a position of the conveyor belt in the belt width direction can be easily determined. As is obvious, the position detection mark 3 is not limited to the triangle shape encompassed by straight lines, and for example, a side of the downstream in the belt moving direction may be a curved line as shown in FIG. 9A and FIG. 9B. Furthermore, as shown in FIG. 9C, a triangle-like shape that connects sides with curved lines is possible. Also, as shown in FIG. 9D, a side of the downstream in the belt moving direction may be in a stair-like shape. Because these shapes of the belt position detection mark 3 still have a plurality of parts of which lengths of the belt moving direction differ in the conveyor belt width direction, if a position in the conveyor belt width direction fluctuates, the mark detection time of the mark detection sensor 1 fluctuates. Therefore, moving distance D in the belt width direction is determined based on the mark detection time. In addition, as shown in FIG. 9A to FIG. 9D, by making a side of the belt position detection mark 3 downstream perpendicular to the belt moving direction, the blank discharge start timing of each of the nozzles can be set based on a timing when the signal from the mark detection sensor 1 turns from the ON signal to the OFF signal.

Also, a transmission-type sensor may be used as the mark detection sensor 1, and a position of the conveyor belt 51 in the width direction may be detected by providing a hole formed as an isosceles triangle or in shapes shown in FIG. 9A to FIG. 9D at an end of the conveyor belt 51. In this case, when a hole of the belt position detection mark 3 faces the transmission-type sensor, light goes through, and the transmission-type sensor detects the light. In contrast, when the conveyor belt 51 faces the transmission-type sensor, since the conveyor belt 51 interrupts the light, the transmission-type sensor cannot detect the light. Hence, if a transmission-type sensor is used for the mark detection sensor 1, the moving distance in the belt width direction can be determined based on the time when the control part 200 has received an ON signal from the mark detection sensor 1. Moreover, the blank discharge start timing of each of the nozzles can be set based on the timing when the signal from the mark detection sensor 1 switches from the ON signal to an OFF signal. In this case, careful consideration to a hole shape is needed because sometimes the hole shape working as the belt position detection mark 3 may deform by tension of the conveyor belt 51.

Furthermore, by providing the belt position detection mark 3 at a non-facing area that does not face the ink discharge area of the conveyor belt 51, the belt position detection mark 3 does not pass under the nozzle of the liquid discharge head 41Y, 41M, 41C, 41K. Therefore, it is possible to prevent the belt position detection mark 3 from getting dirty from ink. As a result, preventing an error detection of the belt position detection mark 3 is possible.

Figure 10:
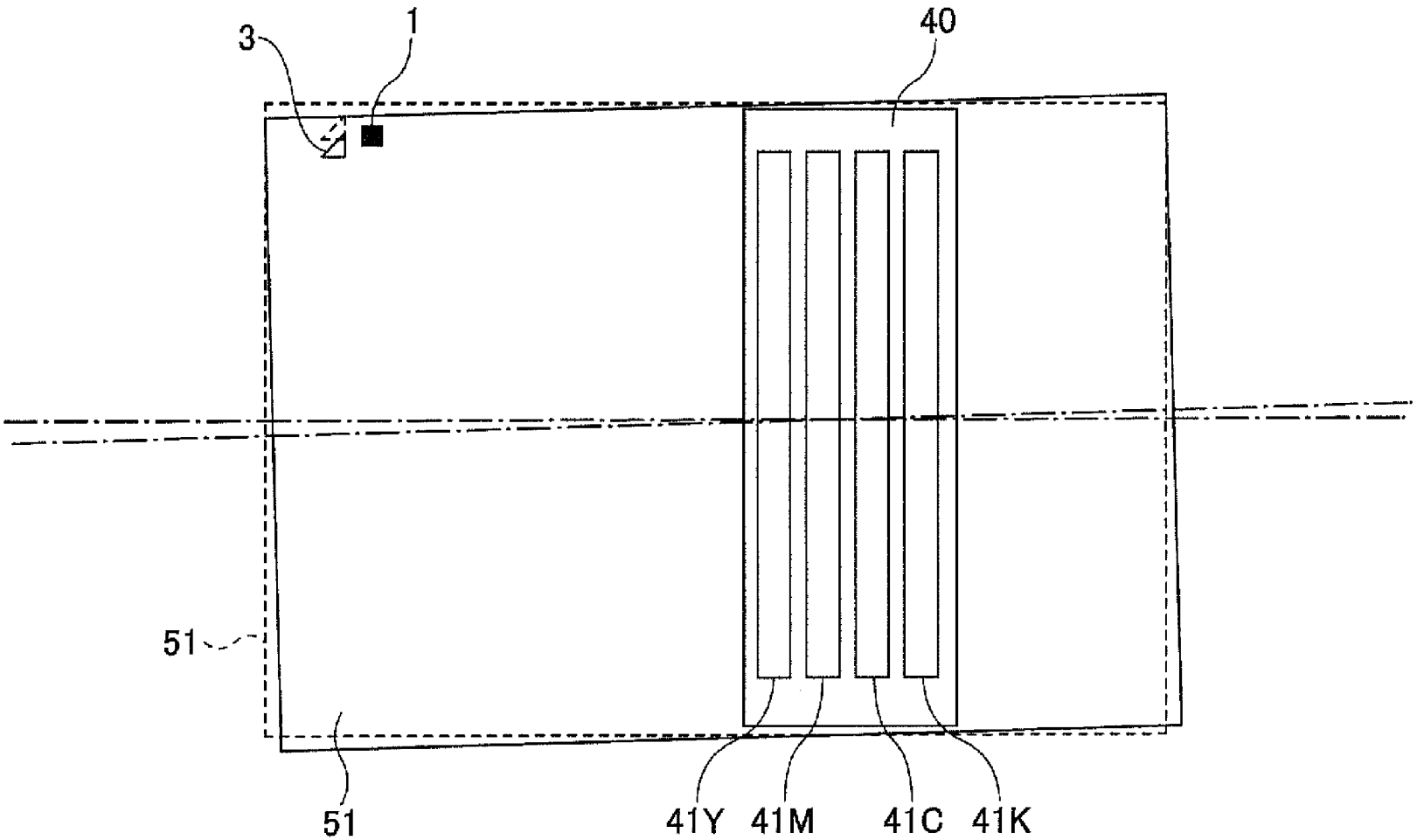
FIG. 10 is a diagram showing an example where a mark detection sensor is away from a liquid discharge head.

In addition, it is preferable to arrange the mark detection sensor 1 in the vicinity of the liquid discharge heads 41Y, 41M, 41C, 41K. For example, as shown in FIG. 10, a case where the mark detection sensor 1 is disposed at a position away from the liquid discharge heads 41Y, 41M, 41C, 41K, is discussed as follows. In the case, as shown by the dotted lines, if the conveyor belt 51 becomes obliquely out of alignment to the head part 40, a shift length of the conveyor belt 51 in the belt width direction at a position of the mark detection sensor 1 becomes longer than that at a position of the liquid discharge heads 41Y, 41M, 41C, 41K. As a result, there is a concern that the moving distance D of the conveyor belt 51 at the position of the liquid discharge heads 41Y, 41M, 41C, 41K cannot be accurately determined from the detection result of the mark detection sensor 1, and the ink for the blank discharge does not pass the suction hole 51*a* but adheres to the conveyor belt 51. Accordingly, like the embodiment, by disposing the mark detection sensor 1 at the head part 40, the moving distance of the conveyor belt 51 in the belt width direction near the liquid discharge heads 41Y, 41M, 41C, 41K can be determined. As a result, as shown by dotted lines in FIG. 10, even if the conveyor belt 51 is obliquely out of alignment, the moving distance in the belt width direction at the position of liquid discharge heads 41Y, 41M, 41C, 41K can be accurately determined based on the detection result of the mark detection sensor 1. This allows the ink for the blank discharge to passes through the suction hole 51*a* and to certainly fall into the blank discharge receivers 71Y, 71M, 71C, 71K.

Moreover, it is possible to provide the mark detection sensor 1, corresponding to each of the liquid discharge heads 41Y, 41M, 41C, 41K. More specifically, a Y-color mark detection sensor, M-color mark detection sensor, C-color mark detection sensor and K-color mark detection sensor are provided at the head part 40, corresponding to each color of the liquid discharge heads 41Y, 41M, 41C, 41K. In this case, the control part 200 controls the blank discharge start timing of each color of the liquid discharge heads 41Y, 41M, 41C, 41K and the blank discharge of the nozzles, based on the detection results of the belt position detection mark 3 by each color of the mark detection sensors. Thus, by providing the mark detection sensors 1 at the head part 40 respectively corresponding to the liquid discharge heads 41Y, 41M, 41C, 41K, the shift lengths of the conveyor belt 51 in the belt width direction at each position of the liquid discharge heads 41Y, 41M, 41C, 41K can be accurately determined. With this, the blank discharge toward the suction hole 51*a* from the liquid discharge heads 41Y, 41M, 41C, 41K can be performed more accurately.

Figure 11:
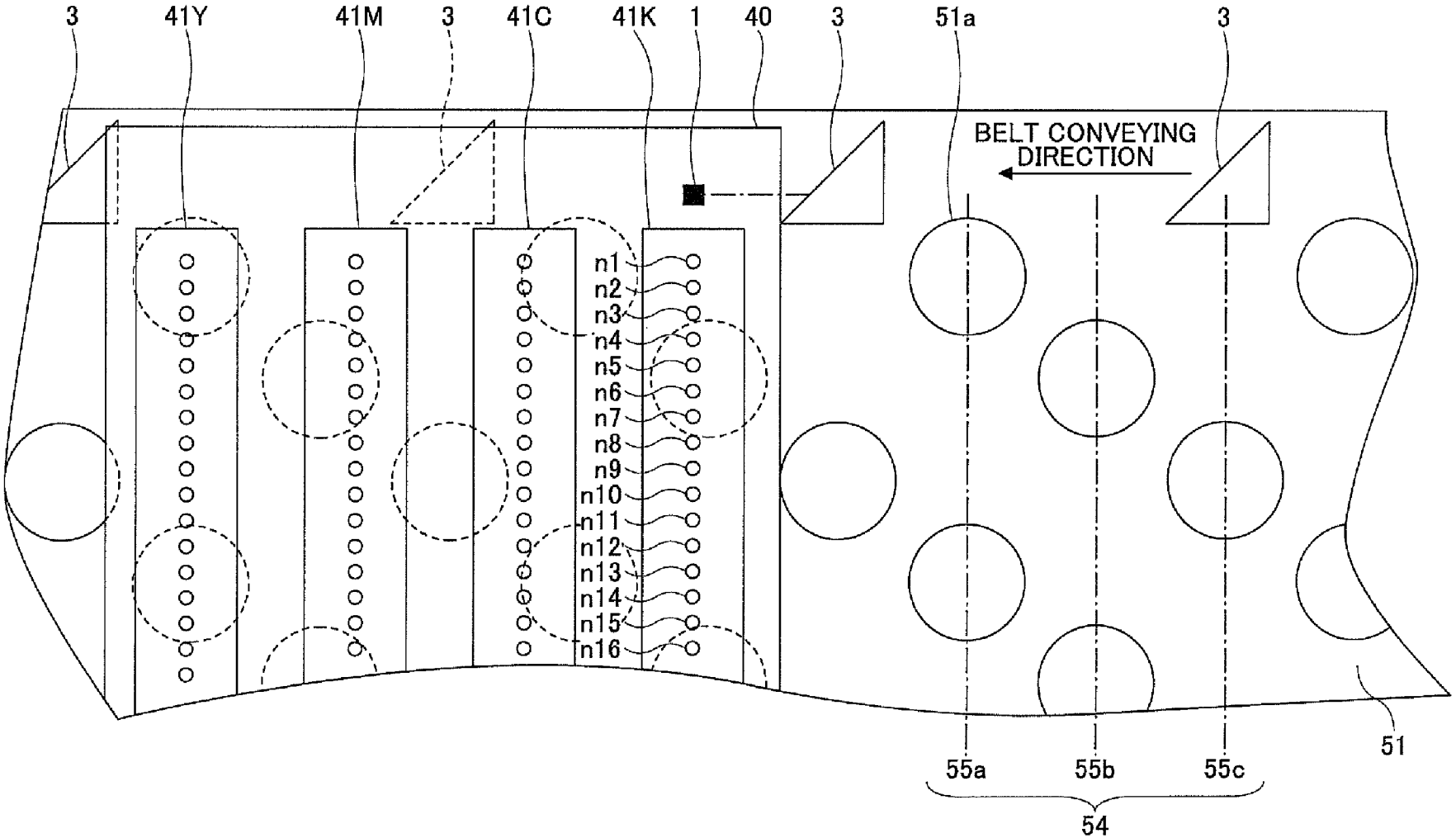
FIG. 11 is a diagram showing an embodiment where a plurality of belt position detection marks are provided.

Furthermore, as shown in FIG. 11, providing a plurality of the belt position detection mark 3 is possible. By providing the plurality of belt position detection mark 3, the mark detection sensor 1 can immediately detect the belt position detection mark 3 after starting a detection. This makes it possible to perform the blank discharge quickly after a back end of the recording medium P passes the back end detection sensor 2, which can shorten a time by completion of the blank discharge.

As discussed above, in the image forming apparatus of the embodiment, since a blank discharge operation of the liquid discharge heads 41Y, 41M, 41C, 41K, an ink discharge unit, is controlled based on the ink detection result by a belt position detection unit, even if the position of the suction hole 51*a*, the blank discharge hole, is out of alignment in the belt width direction, only the nozzles facing the suction hole 51*a* of the conveyor belt 51 can perform the blank discharge. Therefore, it is possible to prevent the ink for the blank discharge discharged toward the conveyor belt 51 from adhering to the conveyor belt 51, which can prevent a surface of the recording medium P in contact with the conveyor belt 51 from getting dirty from the ink, and prevent clothes of an operator from getting dirty from the ink while fixing a paper jam.

In addition, by setting the nozzle that carries out the blank discharge toward each suction hole based on the detection result by the belt position detection unit, and by controlling the blank discharge operation of the liquid discharge head 41Y, 41M, 41C, 41K based on the nozzle setting, only the nozzle facing the suction hole 51*a* of the conveyor belt 51 can conduct the blank discharge even if the position of the suction hole 51*a* of the conveyor belt is shifted in the belt width direction.

Moreover, the belt position detection unit is provided at the conveyor belt 51, and includes the belt position detection mark 3 that has a shape including parts of which lengths are different in the belt moving direction, and the mark detection sensor 1, which is a mark detection unit that detects the belt position detection mark 3. Then, a position of the conveyor belt 51 in a direction perpendicular to the belt moving direction is detected based on a belt position detection mark detecting time. When the conveyor belt 51 moves in the belt width direction, the belt position mark detecting time differs because the belt position detection mark has parts of which lengths of the belt moving direction differ in the direction perpendicular to the belt moving direction. Therefore, by measuring the belt position detection mark detecting time of the mark detection sensor 1, the position of the conveyor belt 51 of the direction perpendicular to the belt moving direction can be detected.

Furthermore, by making the belt detection mark 3 a triangle shape, the moving distance of the conveyor belt 51 and a variation of the belt position mark detecting time of the mark detection sensor 1 become a proportional relationship, which makes it possible to readily detect a position perpendicular to the belt moving direction of the conveyor belt 51.

In addition, the belt position detection mark 3 has a shape including a side upstream in the belt moving direction that is perpendicular to the belt moving direction of the conveyor belt 51, and the control part 200 controls the blank discharge start timing of the liquid discharge head 41Y, 41M, 41C, 41K based on a timing when the mark detection sensor 1 switches from a belt position detection mark detecting state to a belt position detection mark non-detecting state. By making the side upstream in the belt moving direction a shape that is perpendicular to the belt moving direction of the conveyor belt 51, a distance from the side upstream in the belt moving direction of the belt position detection mark 3 to each of the suction hole arrays 55*a*, 55*b*, 55*c* is constant even if the position of the conveyor belt 51 varies in the direction perpendicular to the belt moving direction.

Accordingly, by controlling the blank discharge start timing of the liquid discharge head 41Y, 41M, 41C, 41K based on the timing when the mark detection sensor 1 switches from the belt position detection mark detecting state to the belt position detection mark non-detecting state, the blank discharge is executed at a timing when the suction hole 51*a* faces the liquid discharge head 41Y, 41M, 41C, 41K. This makes unnecessary a device to measure the blank discharge start timing other than the belt position detection unit. As a result, downsizing the image forming apparatus is possible.

Also, by providing the belt position detection mark 3 at a part of the conveyor belt 51 that does not face an ink discharge area of the liquid discharge head 41Y, 41M, 41C, 41K, preventing the belt position detection mark 3 being dirty by ink is possible. This allows the mark detection sensor 1 to adequately detect the belt position detection mark 3.

Moreover, by providing the mark detection sensor 1 at the head part 40 including the liquid discharge heads 41Y, 41M, 41C, 41K, a difference of the conveyor belt 51 in the belt width direction at a position of the liquid discharge heads 41Y, 41M, 41C, 41K can be detected. Hence, even if the conveyor belt 51 is obliquely out of alignment to the head part 40, the difference of the conveyor belt 51 in the belt width direction at the position of the liquid discharge head 41Y, 41M, 41C, 41K can be precisely detected. As a result, the blank discharge toward the suction hole 51*a* can be surely performed.

Furthermore, if there is a nozzle not facing the suction hole 51*a*, the control part 200 raises an alarm to an operator, and stops driving of the image forming apparatus. If the nozzle not facing the suction hole 51*a* carries out the blank discharge, the ink for the blank discharge adheres to the conveyor belt 51, and the conveyor belt 51 becomes tainted. On the other hand, if the nozzle not facing the suction hole 51*a* does not conduct the blank discharge, ink viscosity of the nozzle increases, and a fine image cannot be formed. Consequently, if the nozzle not facing the suction hole 51*a* exists, stopping the drive of the image forming apparatus can prevent forming a poor image. In addition, by alerting an operator, urging repairs and replacement of the conveyance part 50 to the operator is possible.

Thus, according to an image forming apparatus of the embodiments of the present invention, the following advantages can be generated because a blank discharge operation of an ink discharge unit is controlled based on a detection result of a belt position detection unit. It is possible to determine a position of a suction hole of a conveyor belt in a direction perpendicular to a belt moving direction based on the detection result of the belt position detection unit. This makes it possible to determine which nozzle faces which suction hole. Accordingly, if the conveyor belt is shifted in the direction perpendicular to the belt moving direction, it is possible to make a nozzle facing the blank discharge hole perform a blank discharge, and possible to prevent ink for the blank discharge from adhering to the conveyor belt. Therefore, it is possible to prevent a surface of a recording medium in contact with the conveyor belt from getting dirty from the ink, and to prevent an operator's clothes from getting dirty from the ink while fixing a paper jam.

The present invention is not limited to the specifically disclosed embodiments, and variations and modifications may be made without departing from the scope of the present invention.

The present application is based on Japanese Priority Patent Application No. 2008-317618, filed on Dec. 12, 2008, the entire contents of which are incorporated herein by reference.

What is claimed is:

1. An image forming apparatus comprising:

an ink discharge unit including a plurality of nozzles to discharge ink and to form an image on a recording medium by discharging the ink from the plurality of nozzles onto the recording medium;

a conveyer belt to convey the recording medium so that the recording medium passes through an area facing the ink discharge unit, the conveyor belt including a plurality of blank discharge holes to let the ink for a blank discharge from the ink discharge unit through;

a control unit to control an ink discharge operation of the ink discharge unit;

a blank discharge receiver to receive the ink for the blank discharge discharged from the ink discharge unit, provided at a position facing the ink discharge unit across the conveyor belt; and a belt position detection unit to detect a position in a direction perpendicular to a belt moving direction of the conveyor belt, wherein the belt position detection unit includes a belt position detection mark provided on the conveyor belt, and a mark detection unit to detect the belt position detection mark, the belt position detection mark provided on the conveyor belt is shaped to include different lengths in the belt moving direction, at respective different positions in the direction perpendicular to the belt moving direction, and the belt position detection unit detects the position in the direction perpendicular to the belt moving direction based on a mark detection time of the mark detection unit detecting the belt position detection mark; and wherein the control unit controls a blank discharge start timing of the ink discharge unit based on a switching timing from a state detecting the belt position detection mark into a state not detecting the belt position detection mark.

2. The image forming apparatus as claimed in claim 1, wherein the control unit sets the nozzles for the blank discharge onto each of the blank discharge holes, and controls the blank discharge operation of the ink discharge unit based on the set nozzles.

3. The image forming apparatus as claimed in claim 1, wherein the belt position detection mark is in a shape of a triangle.

4. The image forming apparatus as claimed in claim 1, wherein an upstream side of the belt moving direction of the belt position detection mark is perpendicular to the belt moving direction.

5. The image forming apparatus as claimed in claim 1, wherein belt position detection mark is provided at a position not facing an ink discharge area of the ink discharge unit on the conveyor belt.

6. The image forming apparatus as claimed in claim 5, further comprising:

a head part including the ink discharge unit, wherein the mark detection unit is provided in the head part.

7. The image forming apparatus as claimed in claim 1, further comprising:

a determination unit to determine if there is a nozzle not facing any blank discharge holes based on the detection result detected by the belt Position detection unit, and wherein an alarm is raised and drive stops when the determination unit determines that the nozzle not facing the blank discharge holes exists.

* * * * *